US006065883A

United States Patent [19]

Herring et al.

[11] Patent Number: 6,065,883

[45] Date of Patent: May 23, 2000

[54] FRANKING APPARATUS AND PRINTING MEANS THEREOF

[75] Inventors: William James Herring; Daniel John Lee, both of Brentwood, United Kingdom

[73] Assignee: Neopost Limited, Essex, United Kingdom

[21] Appl. No.: 09/145,470

[22] Filed: Sep. 2, 1998

Related U.S. Application Data

[63] Continuation of application No. 08/590,366, Jan. 25, 1996, abandoned.

[30] Foreign Application Priority Data

Jan. 30, 1995 [GB] United Kingdom ..... 9501734

[51] Int. Cl.[7] ..... B41J 3/14

[52] U.S. Cl. ..... 400/225; 400/235.1; 242/564; 318/7

[58] Field of Search ..... 400/225, 234, 400/223, 231, 229, 236, 235.1, 236.1, 236.2, 227, 227.1, 207, 208; 242/376, 554, 564; 318/6, 7

[56] References Cited

U.S. PATENT DOCUMENTS

| | | | |
|---|---|---|---|
| 4,479,081 | 10/1984 | Harris | 318/7 |
| 4,743,811 | 5/1988 | Katayama | 318/7 |
| 4,788,558 | 11/1988 | Caldwell et al. | 400/234 |
| 5,209,587 | 5/1993 | Herbert et al. | 400/225 |
| 5,318,368 | 6/1994 | Fogle et al. . | |
| 5,366,303 | 11/1994 | Barrus et al. | 400/225 |

FOREIGN PATENT DOCUMENTS

| | | |
|---|---|---|
| 0315384 A2 | 5/1989 | European Pat. Off. . |
| 0493944 A1 | 7/1992 | European Pat. Off. . |

OTHER PUBLICATIONS

International Search Report EP 96 300578.0.

*Primary Examiner*—Eugene Eickholt
*Attorney, Agent, or Firm*—Shoemaker and Mattare, Ltd

[57] ABSTRACT

A method and apparatus is disclosed for controlling energization of a take-up motor driving a take-up spool of used ink ribbon in thermal printing apparatus. Prior to a printing cycle, the take-up motor is energized to rotate the take-up spool until ternsion in the ink ribbon caused rotation of an ink ribbon supply spool. The take-up spool is then rotated a predetermined amount and resultant rotation of the supply spool is determined by sensing means. A function dependent upon the rotation of the supply spool is determined and used during subsequent operation of the apparatus to control energization of the take-up motor such as to wind the used riobbon onto the take-up spool with a desired amount of tension in the used ribbon.

7 Claims, 3 Drawing Sheets

FIG. 1
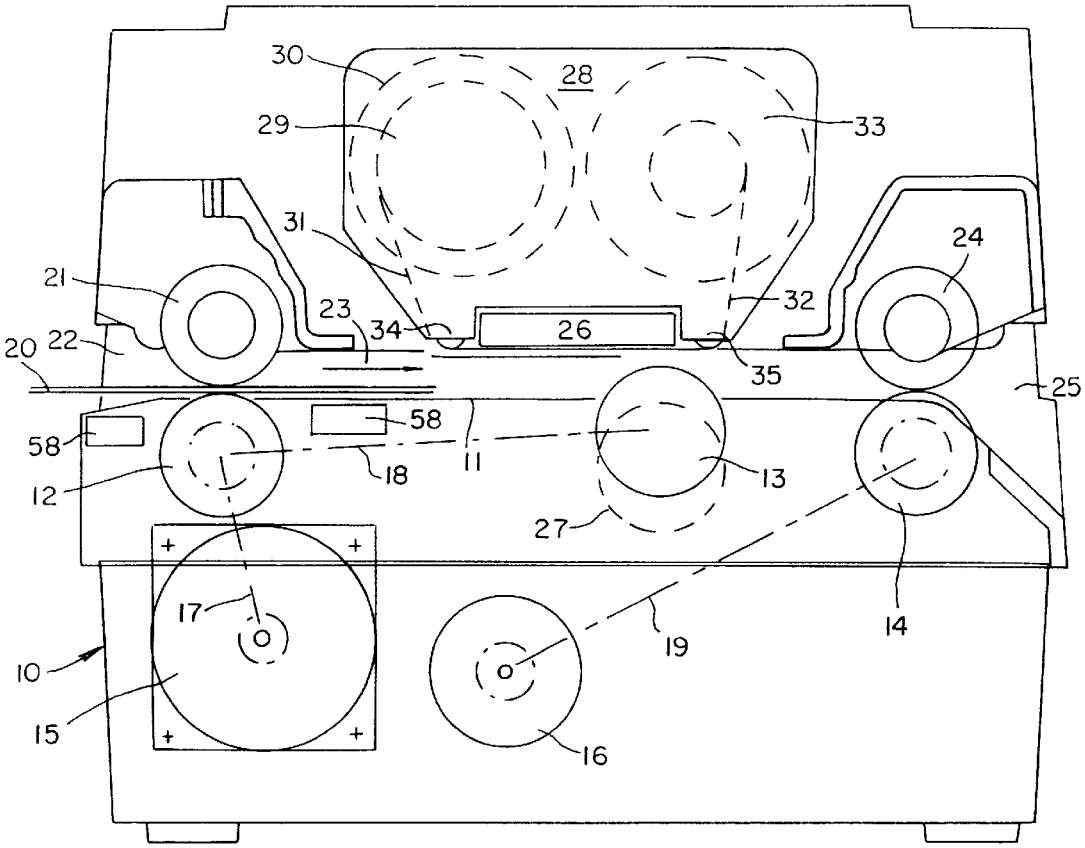
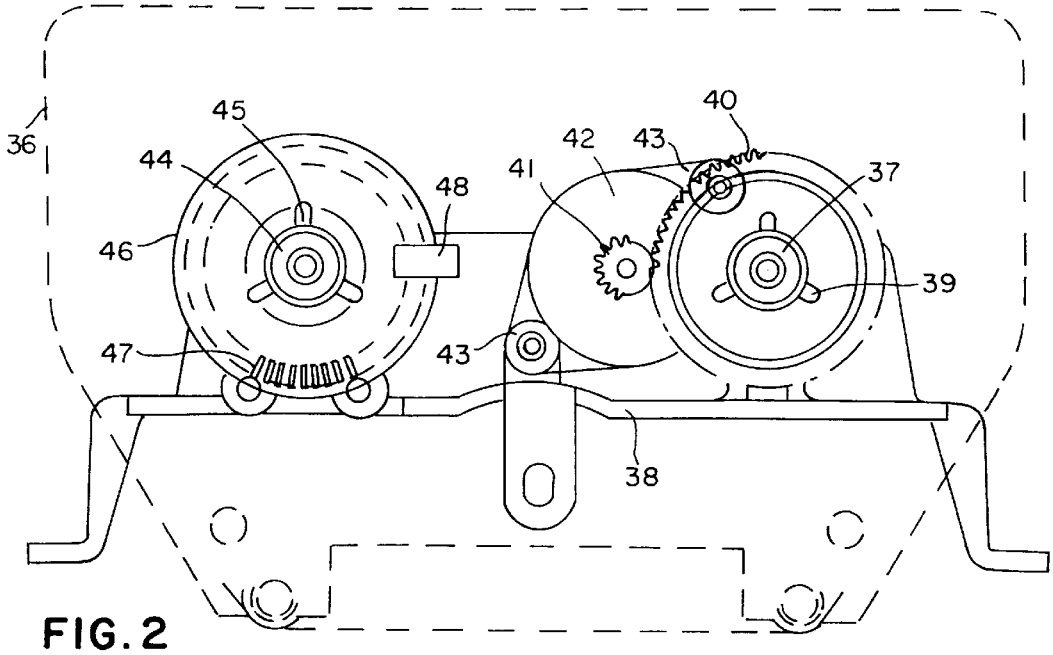
FIG. 2

FRANKING APPARATUS AND PRINTING MEANS THEREOF

This application is a continuation of application Ser. No. 08/590,366, filed Jan. 25, 1996, now abandoned.

BACKGROUND OF THE INVENTION

This invention relates to franking machines and to printing means thereof and in particular to thermal printing means in which ink is transferred from a thermal transfer ink ribbon to a print receiving surface of a mail item.

Franking machines include accounting and control means usually comprising a microprocessor operable to carry out accounting in respect of values of postage charges to be printed on mail item and to decrement a stored value of credit by an amount equal to the value of the postage charge. The microprocessor controls operation of feed means to feed the mail item past a print head and at the same time controls the print head to print a franking impression on the mail item, the franking impression including an indication of the value of the postage charge in respect of that mail item. Previously the print head has been implemented as a rotatable print drum carrying print dies and print wheels, the print dies being utilised to print an invariable part of the franking impression, and a slogan if desired, and the print wheels being settable to print variable parts of the impression comprising the value of postage charge and date. More recently it has been proposed to used a thermal print head to print the franking impression and slogan. The thermal print head includes a plurality of thermal printing elements disposed in a line extending transversely to the direction of feed of the mail item. A thermal transfer ink ribbon is interposed between the thermal printing elements and the mail item with an ink layer of the ribbon in contact with the mail item. As the mail item is fed by the feeding means past the line of thermal printing elements, the contact between the ribbon and the mail item causes the ribbon to adhere to the mail item and thereby to be drawn with mail item past the print head. The thermal printing elements are selectively energised by the control means in each of a plurality of printing cycles so as, in each printing cycle, to heat areas of the ink layer to cause transfer of ink from those areas to the mail item to form dots printed at selected positions on the mail item. Repeated selection and energisation of selected thermal printing elements in a series of printing cycles causes printing of dots to form a required printed impression in a line by line manner on the mail item.

The thermal transfer ink ribbon is supplied wound on a spool (supply spool) and is drawn from the supply spool by the feeding of the mail item past the print head due to the adhesion between the ink layer of the ribbon and the mail item. After passing the print head the used thermal transfer ink ribbon is peeled from the mail item and is wound onto a take-up spool. A motor drive is coupled to the take up spool to rotate the take-up spool so to wind the ribbon onto the take-up spool and to apply, to the used ribbon downstream of the print head, sufficient tension to the used ribbon to effect peeling of the ribbon from the mail item. It will be appreciated that sufficient torque must be applied to the take-up spool to overcome the adhesion between the ink layer and the mail item however the torque must not be so great as to cause the ribbon to be drawn at a higher speed than the speed at which the mail item is fed past the print head. If the ribbon moves at a higher speed past the print head than the mail item, slipping occurs between the ink layer of the ribbon and the surface of the mail item with the result that smudging of the printing impression occurs or is likely to occur.

SUMMARY OF THE INVENTION

According to one aspect of the invention a method of controlling take-up of a used thermal transfer ink ribbon in thermal printing apparatus in which apparatus the thermal transfer ink ribbon is drawn from a supply spool, is fed together with a print receiving medium past a thermal print head in a printing operation to form a print impression on the medium and thereafter the ribbon is peeled from the print receiving medium and wound onto a take-up spool; includes the steps, prior to a printing operation, of rotating the take-up spool through a predetermined angle to draw ribbon from the supply spool; determining the extent of resultant rotation of said supply spool; and in a subsequent printing operation utilising a function dependent upon said extent of resultant rotation of the supply spool to control energisation of a motor drive for rotation of the take-up spool.

According to another aspect of the invention printing apparatus includes a thermal print head; a supply of thermal transfer ink ribbon wound on a rotatable supply spool; said thermal transfer ink ribbon extending from the supply spool past the thermal print head to a rotatable take-up spool; means operable in a printing operation to bring a print receiving medium into engagement with the ink ribbon adjacent the print head and to produce relative movement between the medium and the print head and to energise the print head to produce a print impression in a plurality of printing cycles during said movement; motor drive means energisable to rotate the take-up spool to peel the ribbon from the medium and to wind the ribbon onto the take-up spool; and control means operable prior to the printing operation to energise the motor drive to rotate the take-up spool through a predetermined angle and to determine an extent of rotation of the supply spool resulting from said rotation of said take-up spool through the predetermined angle and said control means being operative during the printing operation to control energisation of the motor drive in dependence upon a function dependent upon said extent of rotation of the supply spool.

BRIEF DESCRIPTION OF THE DRAWING

An embodiment of the invention will be described hereinafter by way of example with reference to the drawings in which:

FIG. 1 illustrates a construction of means for feeding a mail item and a thermal transfer ink ribbon past a thermal print head of a franking machine, FIG. 2 illustrates drive means to which a cassette containing thermal transfer ink ribbon is coupled.

DESCRIPTION OF THE PREFERRED EMBODIMENT

Figure 3:
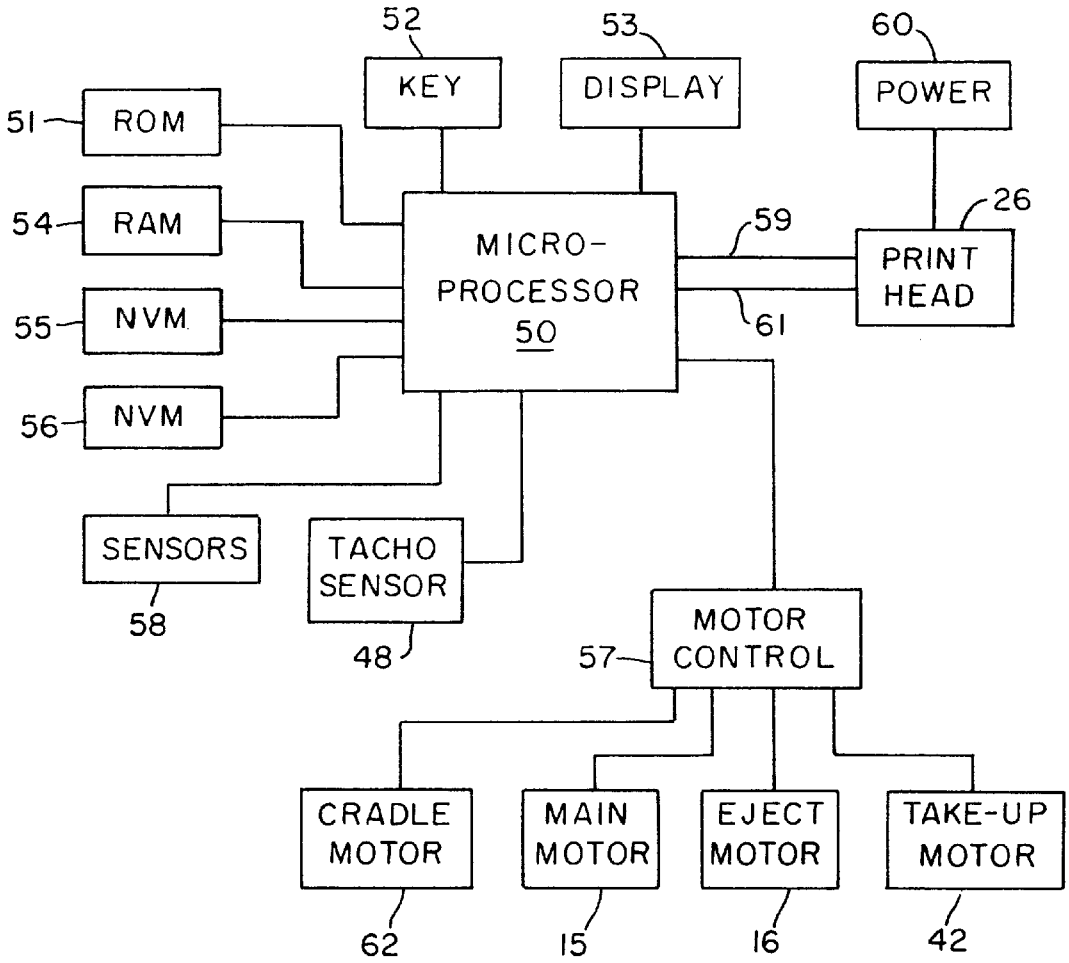
FIG. 3 is a block diagram of accounting and control circuits of the franking machine.

Referring first to FIG. 1, a franking machine includes a housing and chassis 10 having a feed bed 11 extending horizontally therethrough and in which a first input roller 12, an impression roller 13 and a first ejection roller 14 are mounted. The first input roller 12 and impression roller 13 are rotated by means of a first motor 15 through first drive means indicated by broken lines 17 and 18 respectively and the first ejection roller 14 is driven by a second motor 16 through second drive transmission means indicated by broken lines 19. The first input roller 12 and the first ejection roller 14 extend through apertures in the feed bed 11 such that the peripheral surfaces of these rollers project slightly above the feed bed so as to engage mail items 20 to be fed along the feed bed 11. A second input roller 21, which is freely rotatable, is mounted above the first input roller 12 and is resiliently urged toward the first drive roller. The input rollers 12 and 21 together form a nip to resiliently engage and receive therebetween the mail item 20 when inserted at entry 22 to the feed bed 11 and to feed the mail item in the direction of arrow 23 into the franking machine along the feed bed 11. A second ejection roller 24, which is freely rotatable, is mounted above the first ejection roller 14 and is resiliently urged toward the first ejection roller 14. The ejection rollers 14 and 24 together form a nip to resiliently engage and receive therebetween the mail item 20 to eject the mail item through exit 25 from the franking machine. A thermal print head 26 is mounted in spaced relationship with the feed bed 11. The print head 26 has a plurality of thermal printing elements disposed along a line extending in a direction transverse to the direction indicated by arrow 23 of feeding of the mail item. The line of thermal printing elements is parallel to the axis of rotation of the impression roller and the thermal printing elements are disposed in opposition to the peripheral surface of the impression roller 13. The impression roller is mounted in a cradle (not shown) whereby the impression roller can be moved by a cradle motor 62 (FIG. 3) into an operative position as shown in FIG. 1 from an inoperative position, indicated by broken line 27, and returned to the inoperative position. In the operative position the impression roller extends through an aperture in the feed bed so as to project from the feed bed and is resiliently urged toward the print head 26. In the inoperative position the impression roller is retracted to lie below the feed bed 11.

A thermal transfer ink ribbon is contained in a replaceable cassette 28. A supply 29 of unused ribbon is wound on a supply spool 30. The unused ribbon 31 extends from the supply spool 30 out of the cassette to pass below the print head 26 and then the used ribbon 32 passes back into the cassette to be wound onto take-up spool 33. The ribbon comprises a substrate or backing layer carrying a layer of ink which is transferable from the backing layer to an ink receiving medium. The ribbon is disposed such that the backing layer is adjacent the thermal printing elements of the print head and the ink layer faces the feed bed 11.

When an edge of the item 20 is inserted through the entry 22 into the nip between input rollers 12, 21, rotation of the rollers by the motor 15 feeds the mail item along the feed bed. Initially the impression roller is in its inoperative retracted position and the mail item is fed by the input rollers between the impression roller and the print head. The ribbon 31 extends between the mail item and the print head with the ink layer of the ribbon adjacent the mail item. The impression roller is then raised by operation of the cradle motor 62 to the operative position in which the impression roller is resiliently pressed against the lower surface of the mail item. As a result the mail item is pressed into ink transfer contact with the ink layer and the ribbon is pressed into heat transfer contact with the thermal printing elements. The ink layer of the ribbon adheres to the surface of the mail item and rotation of the impression roller by the motor 15 causes the thermal transfer ink ribbon to be drawn by the mail item past the thermal printing elements of the print head.

During passage of the mail item together with the thermal transfer ink ribbon past the thermal printing elements, the thermal printing elements are selectively energised in each of a series of printing cycles to heat areas of the ink layer adjacent the selected elements and thereby to cause those areas of the ink layer to adhere more strongly to the surface of the mail item.

After passing the print head, the ribbon is peeled from the mail item leaving those areas of the ink layer which have been subjected to heating by energised ones of the printing elements adhered to the mail item. Thus by selectively energising the thermal printing elements in each of the series of printing cycles as the mail item and ribbon are fed past the thermal printing elements, areas of the ink layer are caused to adhere to the mail item to form a required printed impression on the mail item. The energisation of the thermal printing elements is controlled by postage metering means such as to print a fixed invariable pattern of a franking impression together with variable data comprising the value of postage charge for the item and the date.

The ribbon is guided by guide rollers 34, 35 mounted in the cassette and disposed respectively upstream and downstream of the print head. Peeling of the used ribbon from the mail item is effected by applying torque to the take-up spool to wind the used ribbon onto the take-up spool and to apply tension to the ribbon downstream of the thermal print elements.

Referring now to FIG. 2, in which the ribbon cassette 28 is indicated by broken line 36, the franking machine is provided with a take-up drive hub 37 mounted for rotation on a sub-chassis 38, the sub-chassis 38 being secured to the housing and chassis 10. The take-up hub 37 has projections 39 to engage in corresponding recesses in the take-up spool 33 of the cassette to transmit drive from the hub 37 to the take-up spool 33. A first gear wheel 40 is secured to and rotatable with the hub 37 and drive is imparted to the gear wheel 40 by means of a second gear wheel 41 secured to a drive shaft of a ribbon take-up stepper motor 42. The stepper motor 42 is secured to the sub-chassis 38 by mountings 43. Upon energisation of the motor with electrical pulses, the motor rotates in a series of steps and, via the gear wheels 41 and 40, rotates the hub 37 and take-up spool engaged therewith. As described hereinbefore with reference to FIG. 1, rotation of the take-up spool causes the used ribbon to be wound onto the take-up spool and tension to be applied to the ribbon so as to peel the used ribbon from the surface of the mail item.

A further rotatable hub 44 is carried on the sub-chassis 38 and is so located as to engage with the supply spool 30 of the ribbon cassette. The hub 44 has projections 45 to engage in corresponding recesses in the supply spool 30 whereby rotation of the supply spool is transmitted to the hub 44. A tachometer disc 46 having a plurality of equally spaced slots 47 is secured to the hub 44. Accordingly when the supply spool is rotated due to ribbon being drawn from the supply spool, the tachometer disc is rotated through an angle equal to the angle of rotation of the supply spool. Sensing means 48 is mounted on the sub-chassis 38 and is responsive to passage of the slots 47 past the sensing means as the tachometer disc 46 is rotated.

Referring now to FIG. 3, operation of the franking machine is effected by means of a micro-processor 50 operating under program routines stored in a read only memory (ROM) 51. As is well known in electronic franking machines, a keyboard 52 is provided for input of data by a user and a display 53 is provided to enable display of information to the user. A random access memory (RAM) 54 is provided for use as a working store for storage of temporary data during operation of the franking machine. Non-volatile duplicated memories 55, 56 are provided for the storage of data which is required to be retained even when the franking machine is not powered. Accounting data relating to use of the franking machine for printing franking impressions representing postage charges for mail items and any other critical data to be retained is stored in the non-volatile memories 55, 56. A motor controller 57 is controlled by the microprocessor 50 to control operation of the motor 15 for driving the input drive roller and the impression roller, to control operation of motor 16 for driving the ejection roller, to control operation of cradle motor 62 to raise and lower the impression roller and to control operation of take-up motor 42 to wind the used ink ribbon 32 onto the take-up spool. Sensors 58 are provided to sense and monitor feeding of the mail item along the feed bed 11. The sensors provide signals to the microprocessor to enable the microprocessor to control feeding of the mail item and energisation of the thermal print elements as the mail item is fed along past the print head. As the mail item is fed past the thermal printing elements of the print head, the microprocessor outputs, on line 59, to the print head 26 in each of a plurality of printing cycles signals selecting those ones of the printing elements which are to be energised in the respective cycle. A pulse of electrical power is supplied to the selected thermal printing elements from a power source 60 when a strobe signal is supplied by the microprocessor on line 61 to the print head. The sensing means 48 for the tachometer disc 46 has an output connected to the microprocessor 50.

The drive power provided by the stepper motor 42 is of a magnitude such as to provide drive to the take-up spool sufficient to wind the used ribbon onto the take-up spool also to apply sufficient tension to the used ribbon 32 as it passes round the guide roller 35 of the cassette to ensure that the used ribbon is peeled from the mail item. The drive power provided by the stepper motor 42 must not be of a magnitude to exert sufficient tension in the ribbon as to cause the ribbon to drawn past the print head faster than the mail item is fed past the print head. If the speed of travel of the ribbon is greater than that of the mail item smudging of the printed impression on the mail item occurs or is likely to occur.

It will be appreciated that as the used ribbon is wound onto the take-up spool the diameter of the used ribbon on the take-up spool increases and as ribbon is drawn from the supply spool the diameter of the unused ribbon on the supply spool decreases. Accordingly if the stepper motor were to be energised by electric pulses to produce the same rate and number of drive steps regardless of the diameter of the wound used ribbon, the tension applied to the used ribbon would vary and may increase to such an extent as to tend to draw the ribbon faster than the mail item is fed so that the ribbon is moved relative to the mail item.

Figure 4:
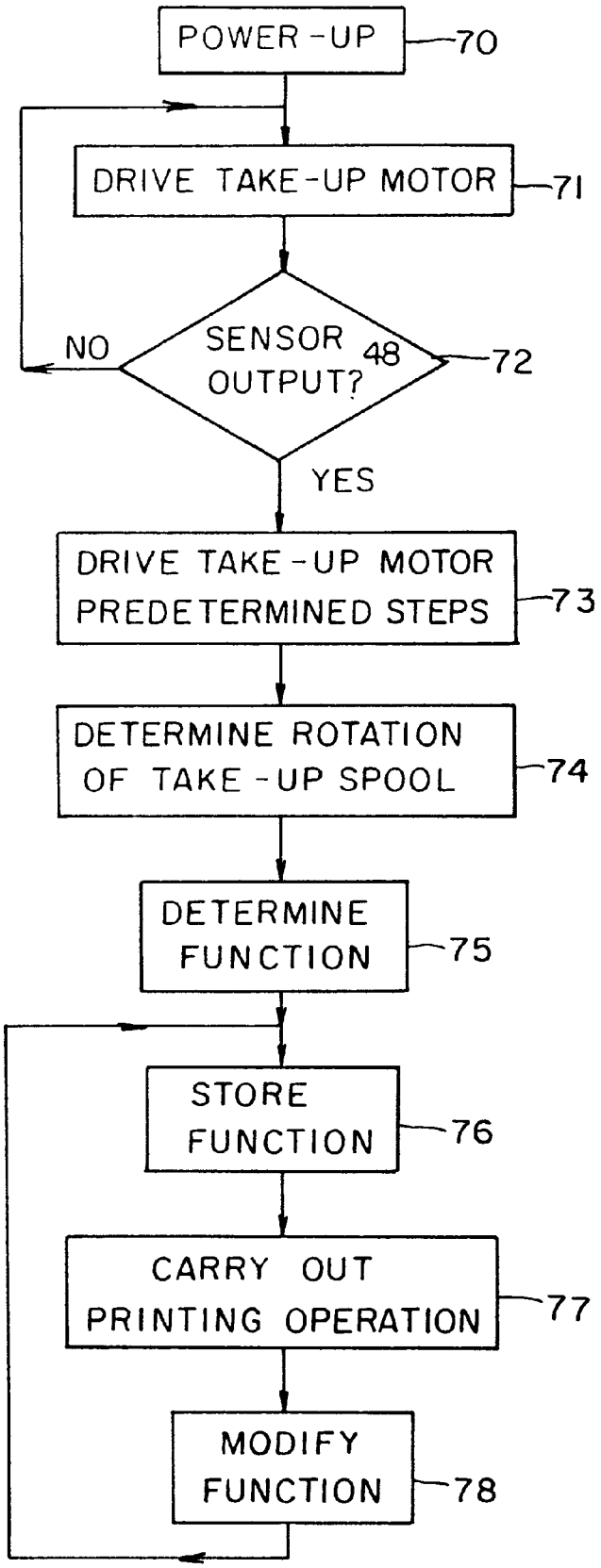
FIG. 4 is a flow chart relating to control of drive means for ribbon take-up.

In order to maintain the tension applied to the ribbon within desired limits, periodically the franking machine is operated to carry out a routine, illustrated by the flow chart of FIG. 4, to determine the number and rate of steps of energisation required for the take-up stepper motor 38.

At power up (step 70) of the franking machine the impression roller 13 is in the retracted inoperative position and the ribbon adjacent the print head is unrestrained and free. Drive pulses are applied (step 71) to energise the take-up stepper motor 42 to rotate the take-up spool. This rotation of the take-up spool takes up slack in the ribbon between the supply and take up spools. A determination (decision box 72) is made as to whether all the slack in the ribbon has been taken up by testing the output of sensing means 48. If no movement of the tachometer disc is detected (NO exit of box 72) the energisation of the take-up motor 42 is continued. When the sensing means 48 detects movement of the tachometer disc (YES exit of box 72) and hence that the supply spool has been rotated through a small angle due to tension in the ribbon, any slack which was present in the ribbon has been removed. The motor 42 is then energised (step 73) with a predetermined number of drive pulses to rotate the take-up spool through a predetermined angle and the resultant angle of rotation of the supply spool is determined (step 74) by monitoring the output of sensing means 48. The relationship between the predetermined number of drive pulses and the resultant output of the sensing means 48 is determined (step 75) as a function, for example as a ratio, and is stored (step 76). In a subsequent printing operation (step 77), the mail item is fed by the rollers along the feed bed past the print head and the stored relationship is utilised by control software to determine the number and rate of energisation steps of the take-up motor 42 to peel the used ribbon from the mail item and to wind the used ribbon onto the take-up spool.

It may be sufficient to carry out the routine described hereinbefore each time the franking machine is powered up and to utilise the stored relationship for the duration that the machine is powered. Such an arrangement may be satisfactory for machines having a relatively low volume of use. However for machines having a relatively high volume of use, the change in diameter of used ribbon wound on the take-up spool during a single powering of the machine may be such as to cause an undesirable change in tension applied to the ribbon. Franking impressions printed by the machine on mail items are of the same length and hence equal lengths of ribbon are used for printing each franking impression. Since the franking impressions are all of equal length, the relationship changes as a function of the number of franking impressions printed. The microprocessor 50 modifies (step 78) the relationship for each franking impression printed and stores (step 76) the modified relationship so as to maintain the relationship approximately related to the diameter of the used ribbon wound on the take-up spool during use of the machine.

The franking machine may be capable of printing a slogan or other secondary print alongside the franking impression, the secondary print being of predetermined length. Accordingly when a secondary print is printed with the franking impression, the stored relationship is modified to a different extent such as to take into account the overall length of the printed impression comprising the franking impression and the secondary print.

It will be appreciated that during use of the franking machine to print franking impressions, the take-up spool is rotated by energising the take up motor 42 with pulses and the supply spool rotates as the ribbon is drawn from he supply spool. Accordingly the relationship may be determined continuously or periodically during use of the machine and the current stored value of the relationship is overwritten upon each determination of the relationship.

We claim:

1. A method of controlling take-up of a used thermal transfer ink ribbon in thermal printing apparatus in which thermal transfer ink ribbon is drawn from a supply spool and after use of the ribbon for printing the used ribbon is wound onto a take-up spool including in a pre-printing operation prior to a printing operation the steps of rotating the take-up spool through a predetermined angle to draw ribbon from the supply spool and determining the extent of resultant rotation of said supply spool; and in a subsequent printing operation in which a thermal print head is selectively operated to cause ink to be transferred from the ink ribbon to the print receiving medium the steps of bringing the thermal transfer ribbon into adherent ink transfer engagement with the print receiving medium; feeding the print receiving medium and the thermal transfer ink ribbon in adherent engagement therewith past the thermal print head and utilizing a function dependent upon said extent of rotation of the supply spool to control energization of a motor drive to drive the take-up spool to apply a substantially uniform tension to the used thermal ink transfer ribbon effective to peel said used thermal transfer ink ribbon from said adherent engagement with the print receiving medium and ineffective due to said adherent engagement of said thermal transfer ink ribbon with the print receiving medium during the printing operation to cause relative movement between the thermal transfer ribbon and the print receiving medium.

2. A method as claimed in claim 1 further including the step, prior to the step of rotating the take-up spool through the predetermined angle, of rotating the take-up spool until resultant rotation of the supply spool occurs.

3. A method as claimed in claim 1 including the step between a first printing operation and a second printing operation subsequent to said first printing operation of modifying the function in dependence upon an extent by which the ribbon is fed during said first printing operation.

4. A method as claimed in claim 2 including the step between a first printing operation and a second printing operation subsequent to said first printing operation of modifying the function in dependence upon an extent by which the ribbon is fed during said first printing operation.

5. Thermal transfer printing apparatus including a thermal print head; a supply of thermal transfer ink ribbon wound on a rotatable supply spool; said thermal transfer ink ribbon extending from the supply spool past the thermal print head to a rotatable take-up spool; motor drive means operable to apply rotational drive to the supply spool to wind said thermal transfer ink ribbon thereon; control means operative prior to a printing operation to energize the motor drive means to rotate the take-up spool through a predetermined angle to draw the thermal transfer ink ribbon from the supply spool and to determine an extent of rotation of the supply spool resulting from said rotation of said take-up spool through said predetermined angle; means operable to bring a print receiving medium into adhering engagement with the ink ribbon adjacent the print head and to maintain said adhering engagement for the duration of the printing operation and to produce relative movement between the print receiving medium and the print head during the printing operation, said adhering engagement of the print receiving medium and the ink ribbon being effective to feed the ink ribbon with the feeding of the print receiving medium and to draw the ink ribbon from the supply spool, said control means being operative for the duration of the printing operation to energize the print head to produce a print impression by transfer of ink from the thermal transfer ink ribbon to the print receiving medium in a plurality of printing cycles during said relative movement and said control means being operable for the duration of the printing operation to energize said motor drive means to rotate the take-up spool in dependence upon a function dependent upon said extent of rotation of the supply spool so as to apply a substantially uniform tension to the thermal transfer ribbon effective to peel the thermal transfer ink ribbon from the print receiving medium but ineffective to cause relative movement between the thermal transfer ink ribbon and the print receiving medium.

6. Printing apparatus as claimed in claim 5 wherein the motor drive means includes a stepper motor energised by drive pulses and the control means is operative to control rate of application of said drive pulses to the motor drive means in dependence upon the function.

7. A method of printing a franking impression on a mail item including the steps, prior to commencement of printing the franking impression, of rotating a take-up spool through a predetermined angle to wind ink ribbon onto the take-up spool and thereby draw ink ribbon from a supply spool and determining an extent of rotation of said supply spool as a result of the rotation of the take-up spool through said predetermined angle; thereafter in a printing operation to print a franking impression bringing a mail item to receive the franking impression into an adhering ink transfer engagement with the ink ribbon and the ink ribbon into heat transfer engagement with a thermal print head and maintaining said engagements during printing of the franking impression; feeding said mail item past the print head at a feed speed, the engagement of the mail item with the ink ribbon being effective to feed the ink ribbon at the feed speed with the mail item and solely effective to draw the ink ribbon from the supply spool; operating the print head during feeding of the mail item past the print head to cause transfer of ink from the ink ribbon to the mail item to print the franking impression and for a duration of printing at least the franking impression utilizing a function dependent upon said extent of rotation of the supply spool prior to said printing to control energization of a motor drive for rotation of the take-up spool to apply a substantially uniform tension to ink ribbon that has been used for printing effective to peel the used ribbon from the mail item and ineffective to draw the ribbon at a speed greater than said feed speed.

* * * * *